US012678848B2

(12) United States Patent
McNurlin et al.

(10) Patent No.: US 12,678,848 B2
(45) Date of Patent: Jul. 14, 2026

(54) HYDRAULIC CONDUIT BENDER

(71) Applicant: Southwire Company, LLC, Carrollton, GA (US)

(72) Inventors: Randall McNurlin, Phoenix, AZ (US); Travis Nelson, Glendale, AZ (US); David Bardin, Bonne Terre, MO (US)

(73) Assignee: Southwire Company, LLC, Carrollton, GA (US)

( * ) Notice: Subject to any disclaimer, the term of this patent is extended or adjusted under 35 U.S.C. 154(b) by 261 days.

(21) Appl. No.: 18/354,225

(22) Filed: Jul. 18, 2023

(65) Prior Publication Data

US 2024/0017315 A1 Jan. 18, 2024

Related U.S. Application Data

(60) Provisional application No. 63/368,712, filed on Jul. 18, 2022.

(51) Int. Cl.
*B21D 7/024* (2006.01)

(52) U.S. Cl.
CPC ..... *B21D 7/024* (2013.01)

(58) Field of Classification Search
CPC ..... B21D 7/02; B21D 7/021; B21D 7/024; B21D 37/02
USPC ..... 72/705
See application file for complete search history.

(56) References Cited

U.S. PATENT DOCUMENTS

| | | | | | |
|---|---|---|---|---|---|
| 4,555,926 | A * | 12/1985 | Bieli-Moschlin | B21D 1/08 | 72/392 |
| 4,558,583 | A * | 12/1985 | Shaw, Sr. | B21D 7/063 | 72/157 |
| 4,915,342 | A * | 4/1990 | Nilsson | B21D 1/145 | 248/500 |
| 4,949,569 | A * | 8/1990 | Young | B21D 1/14 | 72/457 |
| 4,967,585 | A * | 11/1990 | Grimaldo | B21D 7/06 | 72/389.8 |
| 5,528,921 | A * | 6/1996 | Herman | B21D 7/06 | 72/213 |
| 9,327,328 | B1 * | 5/2016 | Ceballos, Sr. | B21D 1/10 | |
| 2011/0271735 | A1 * | 11/2011 | Plummer | B21D 7/12 | 188/74 |
| 2021/0276064 | A1 * | 9/2021 | Fiorentini | B21D 7/12 | |

OTHER PUBLICATIONS

881-MBT Mobile Bending Table Instruction Manual, Greenlee / A Textron Company, 2014, 28 pages.

* cited by examiner

*Primary Examiner* — Edward T Tolan
(74) *Attorney, Agent, or Firm* — Merchant & Gould P.C.

(57) ABSTRACT

A hydraulic conduit bender may be provided. The hydraulic conduit bender may comprise a mast and a main bending cylinder. The mast may be disposed in a working position. The main bending cylinder may be disposed in the mast. The main bending cylinder may be operative to accept, on a throw extending from the main bending cylinder when the mast is in the working position, different sizes of a plurality of bending shoes without having to adjust a position of the main bending cylinder within the mast.

17 Claims, 10 Drawing Sheets

HYDRAULIC CONDUIT BENDER

CROSS REFERENCE TO RELATED APPLICATIONS

This application is a non-provisional application which claims a benefit of priority to U.S. Provisional Application No. 63/368,712, filed Jul. 18, 2022, hereby incorporated herein by reference in its entirety.

BACKGROUND

An electrical conduit is a tube used to protect and route electrical wiring in a building or non-building structure. Electrical conduit may be made of metal, plastic, fiber, or fired clay. Most conduit is rigid, but flexible conduit is used for some purposes. Conduit is generally installed by electricians at the site of installation of electrical equipment. Its use, form, and installation details are often specified by wiring regulations, such as the US National Electrical Code (NEC) and other building codes.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1B:
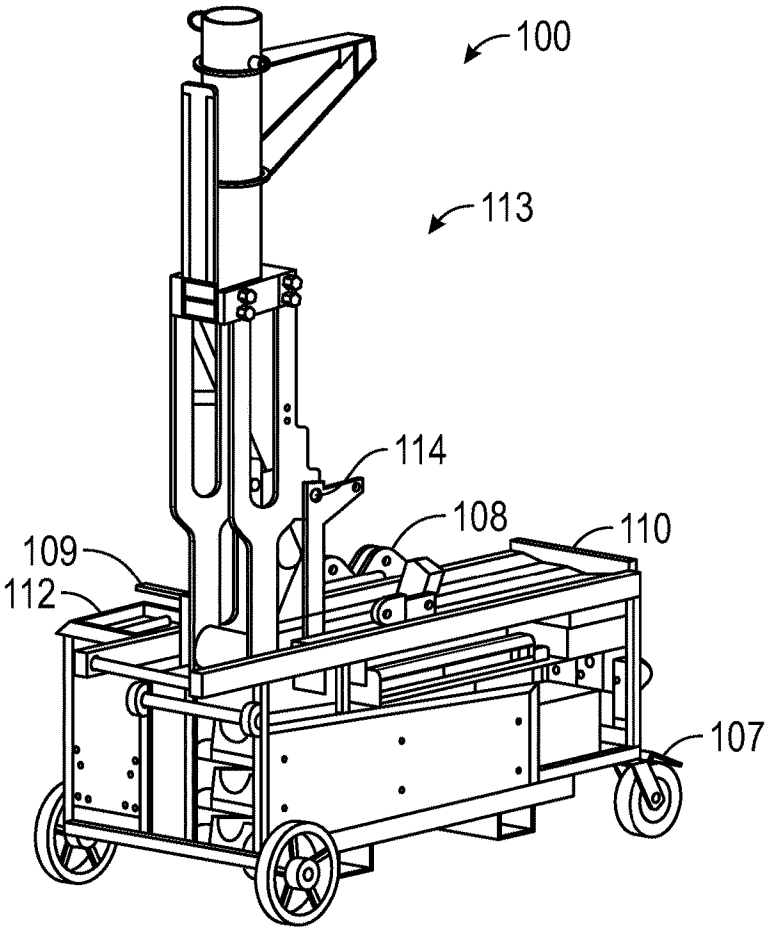
FIGS. 1A and 1B shows hydraulic conduit bender.

A hydraulic conduit bender may be provided. The hydraulic conduit bender may comprise a mast and a main bending cylinder. The mast may be disposed in a working position. The main bending cylinder may be disposed in the mast. The main bending cylinder may be operative to accept, on a throw extending from the main bending cylinder when the mast is in the working position, different sizes of a plurality of bending shoes without having to adjust a position of the main bending cylinder within the mast.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

EXAMPLE EMBODIMENTS

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Electrical wiring is an electrical installation of cabling and associated devices such as switches, distribution boards, sockets, and light fittings in a structure. Wiring is subject to safety standards for design and installation. Allowable wire and cable types and sizes may be specified according to the circuit operating voltage and electric current capability, with further restrictions on the environmental conditions, such as ambient temperature range, moisture levels, and exposure to sunlight and chemicals.

Associated circuit protection, control, and distribution devices within a building's wiring system may be subject to voltage, current, and functional specifications. Wiring safety codes vary by locality, country, or region. The International Electrotechnical Commission (IEC) is attempting to harmonize wiring standards among member countries, but significant variations in design and installation requirements may still exist. Wiring installation codes and regulations may be intended to protect people and property from electrical shock and fire hazards. They may be based on a model code produced by a national or international standards organization.

Building wire and cable are used in the construction of almost every commercial, industrial, and residential property. Most commonly known as branch circuit wiring in homes and businesses, these products carry electrical current to all power applications in a building or dwelling.

An electrical conduit may comprise a tube used to protect and route electrical wiring in a building or structure. Electrical conduit may be made of metal, plastic, fiber, or fired clay. Most conduit may be rigid, but flexible conduit may be used for some purposes. Conduit may generally be installed by electricians at a site of installation of electrical equipment. Its use, form, and installation details may be specified by wiring regulations, such as the National Electrical Code (NEC) and other building codes.

Electrical conduit provides protection to enclosed conductors from impact, moisture, and chemical vapors. Varying numbers, sizes, and types of conductors may be pulled into a conduit, which may simplify design and construction compared to multiple runs of cables or the expense of customized composite cable. Wiring systems in buildings may be subject to frequent alterations. Frequent wiring changes may be made simpler and safer through the use of electrical conduit, as existing conductors may be withdrawn and new conductors installed, with little disruption along the path of the conduit. When installing conduit, the conduit may need to be bent.

Embodiments of the disclosure may provide a hydraulic conduit bender that, for example, may bend 2.5 inch, 3.0 inch, 3.5 inch, and 4.0 inch galvanized Electrical Metallic Tubing (EMT), Galvanized Intermediate Metallic Conduit (IMC), and galvanized rigid conduit. A main bending mast may be hydraulicly raised for working and hydraulicly lowered for storage. Embodiments of the disclosure may include a main bending cylinder that may comprise a dual-action cylinder that may enable fast and precise, in and out, vertical adjustments. The main bending cylinder may also comprise a long-travel cylinder that may eliminate the need to adjust the main bending cylinder's height in the main bending mast when different sized bending shoes are attached to the hydraulic conduit bender. Also, the bending shoes, follow bars, and hooks may have unique indicia (e.g., color-coded) for easy identification and access.

Figure 1A:
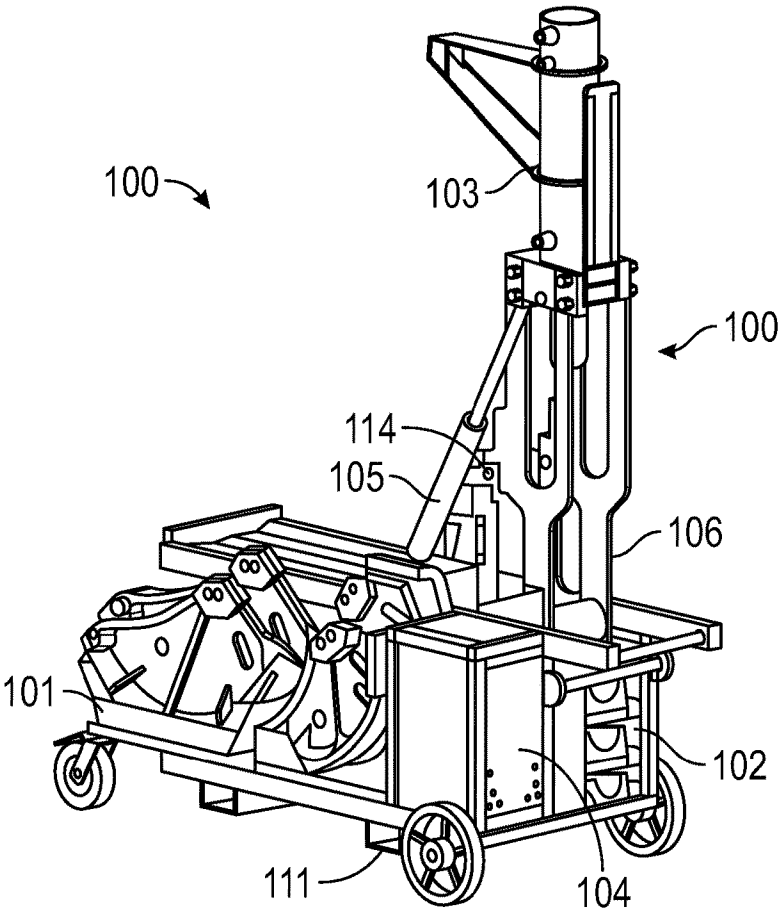

FIG. 1A and FIG. 1B show a hydraulic conduit bender 100. As shown in FIG. 1A and FIG. 1B, hydraulic conduit bender 100 may comprise a bending shoe storage 101, a follow bar storage 102, a main bending cylinder 103, a main control panel 104, a mast elevation cylinder 105, a yoke 106, front casters 107, a vise 108, an elevation mast lock 109, a hook storage 110, fork lifting tubes 111, a tool tray 112, a mast 113, and a pivot point 114. Mast 113 may comprise yoke 106 in which main bending cylinder 103 may be disposed.

Main bending cylinder 103 and mast elevation cylinder 105 may comprise hydraulic cylinders that may be controlled by an operator through main control panel 104. Main bending cylinder 103 may be powered by hydraulic fluid to move a throw (described in greater detail below) in both a direction out of main bending cylinder 103 and a direction into main bending cylinder 103. Mast elevation cylinder 105 may be similar.

Bending shoe storage 101 may be used to store a plurality of bending shoes 200 as described in greater detail below with resect to FIG. 2. Hook storage 110 may be used to store a plurality of hooks 300 as described in greater detail below with respect to FIG. 3. Follow bar storage 102 may be used to store a plurality of follow bars 400 as described in greater detail below with respect to FIG. 4.

An operator of hydraulic conduit bender 100, using main control panel 104, may cause mast elevation cylinder 105 to rotate mast 113 about pivot point 114 and go from a stored position (i.e., substantially horizontal) to a working position (i.e., substantially vertical). FIG. 1A and FIG. 1B show mast 113 of hydraulic conduit bender 100 in the working position. Elevation mast lock 109 may lock mast 113 in the stored position or in the working position. Elevation mast lock 109 may be actuated by the operator to unlock mast 113 from the stored position or from the working position.

Figure 2:
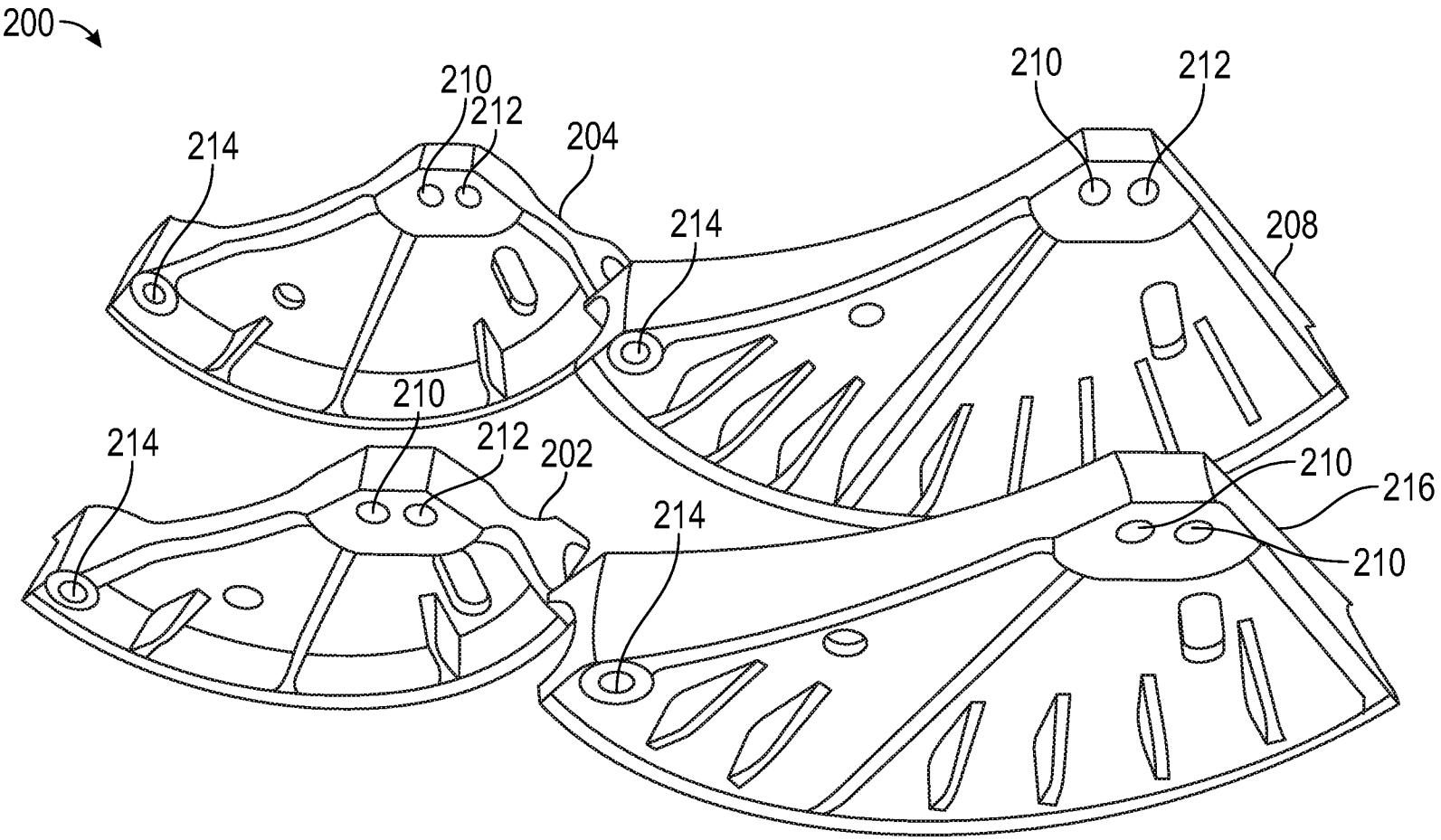
FIG. 2 shows a plurality of bending shoes.

FIG. 2 shows plurality of bending shoes 200. As shown in FIG. 2, plurality of bending shoes 200 may comprise a first bending shoe 202, a second bending shoe 204, a third bending shoe 206, and a fourth bending shoe 208. Each one of plurality of bending shoes 200 may be used for bending different diameter conduits. Also, each one of plurality of bending shoes 200 may be of a different size compared to other ones of plurality of bending shoes 200. For example, first bending shoe 202 may be used when bending 2.5 inch conduit, second bending shoe 204 may be used when bending 3.0 inch conduit, third bending shoe 206 may be used when bending 3.5 inch conduit, and fourth bending shoe 208 may be used when bending 4.0 inch conduit.

Each one of plurality of bending shoes 200 may comprise a first clevis pin hole 210, a second clevis pin hole 212, and a hook pin hole 214. As described in greater detail below, first clevis pin hole 210 and second clevis pin hole 212 may be used to connect any one of plurality of bending shoes 200 to a clevis disposed at a bottom of a throw extending from main bending cylinder 103. For example, first clevis pin hole 210 may be used when bending galvanized EMT and second clevis pin hole 212 when bending galvanized IMC and galvanized ridge conduit. Each one of plurality of bending shoes 200 may comprise a marking that may indicate first clevis pin hole 210 may be used when bending EMT. As described in greater detail below, hook pin hole 214 may be used to connect any one of plurality of bending shoes 200 to any one of the plurality of hooks 300.

Figure 3:
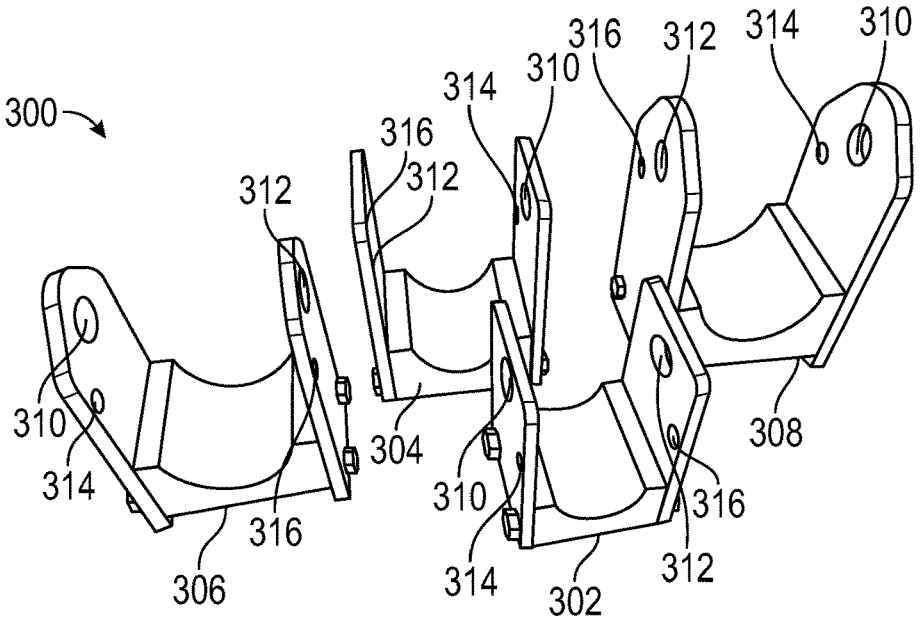
FIG. 3 shows a plurality of hooks.

FIG. 3 shows plurality of hooks 300. As shown in FIG. 3, plurality of hooks 300 may comprise a first hook 302, a second hook 304, a third hook 306, and a fourth hook 308. Each one of plurality of hooks 300 may be used for bending different diameter conduits. For example, first hook 302 may be used when bending 2.5 inch conduit, second hook 304 may be used when bending 3.0 inch conduit, third hook 306 may be used when bending 3.5 inch conduit, and fourth hook 308 may be used when bending 4.0 inch conduit. Each one of plurality of hooks 300 may comprise a first hook pin hole 310, a second hook pin hole 312, a first assist pin hole 314, and a second assist pin hole 316. As described in greater detail below, first hook pin hole 310 and second hook pin hole 312 may be used in connect any one of plurality of hooks 300 to any one of plurality of bending shoes 200. As described in greater detail below, first assist pin hole 314 and second assist pin hole 316 may be used to hold any one of plurality of hooks 300 to a conduit that is to be bent by hydraulic conduit bender 100.

Figure 4:
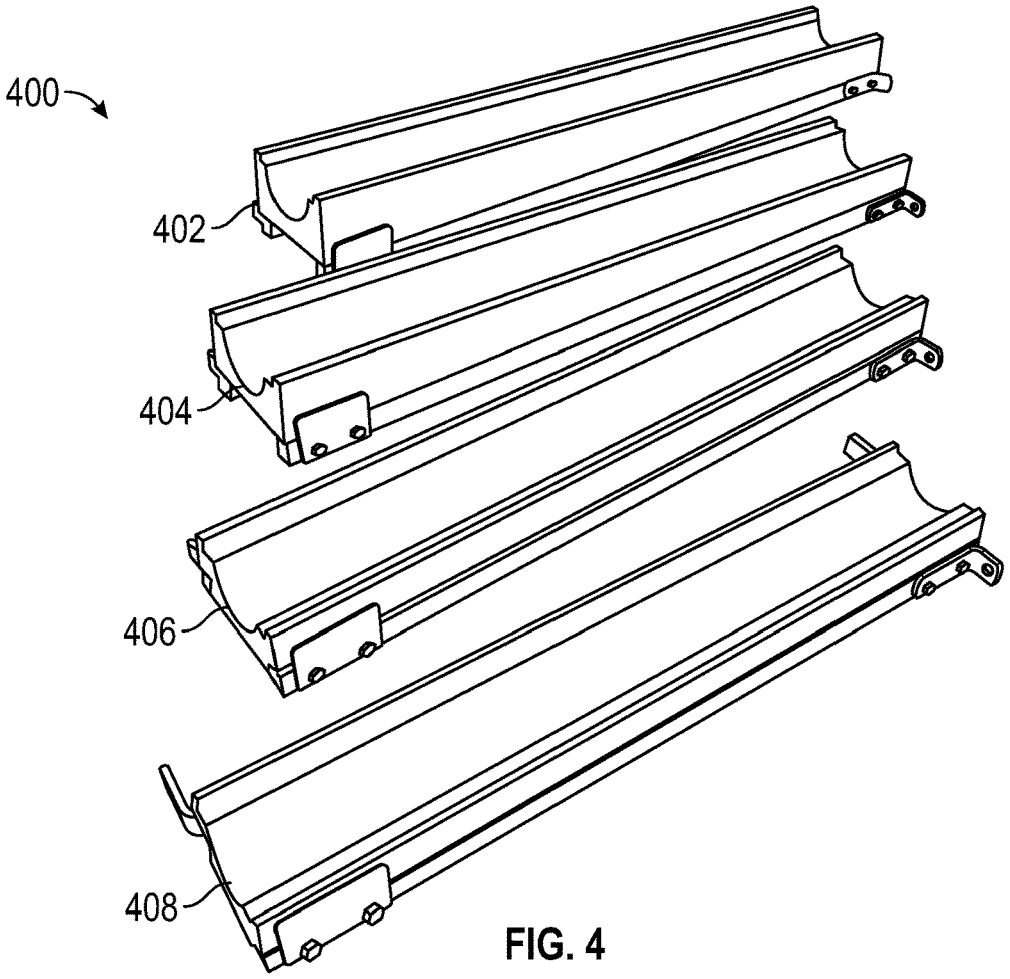
FIG. 4 shows a plurality of follow bars.

FIG. 4 shows plurality of follow bars 400. As shown in FIG. 4, plurality of follow bars 400 may comprise a first follow bar 402, a second first follow bar 404, a third first follow bar 406, and a fourth first follow bar 408. Each one of plurality of follow bars 400 may be used for bending different diameter conduits. For example, first follow bar 402 may be used when bending 2.5 inch conduit, second follow bar 404 may be used when bending 3.0 inch conduit, third follow bar 406 may be used when bending 3.5 inch conduit, and fourth follow bar 408 may be used when bending 4.0 inch conduit.

Consistent with embodiments of the disclosure, an indicia may be used to indicate which ones of plurality of follow bars 400 respectively correspond to which ones of plurality of hooks 300 that respectively correspond to which ones of plurality of bending shoes 200. The indicia may comprise, but is not limited to, a color coding system. For example, first bending shoe 202, first hook 302, and first follow bar 402 may be marked in red because they may be associated with bending 2.5 inch conduit. Second bending shoe 204, second hook 304, and second follow bar 404 may be marked in white because they may be associated with bending 3.0 inch conduit. Third bending shoe 206, third hook 306, and third follow bar 406 may be marked in blue because they may be associated with bending 3.5 inch conduit. Fourth bending shoe 208, fourth hook 308, and fourth follow bar 408 may be marked in yellow because they may be associated with bending 4.0 inch conduit.

Figure 5:
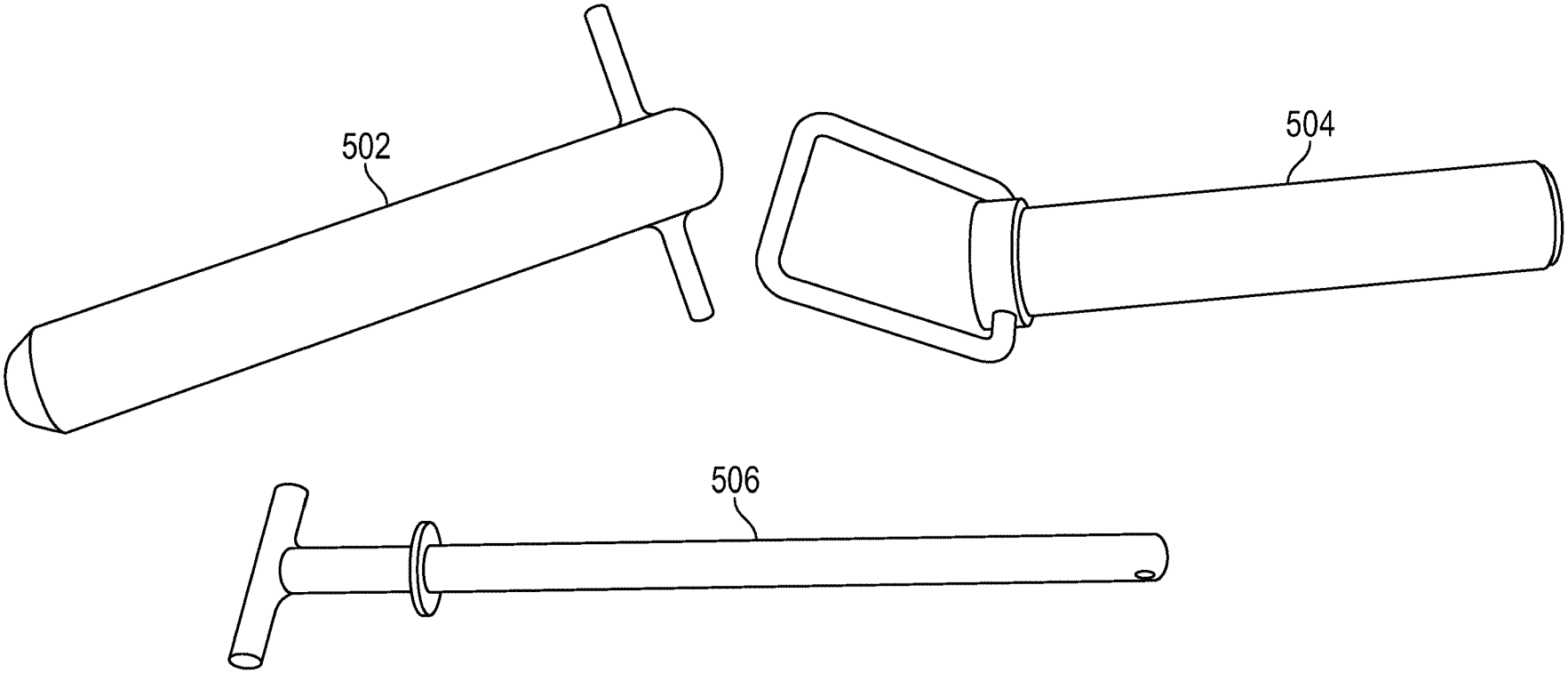
FIG. 5 shows a plurality of pins.

FIG. 5 shows a plurality of pins used in conjunction with hydraulic conduit bender 100. As shown in FIG. 5, embodiments of the disclosure may use a hook pin 502, a clevis pin 504, and an assist pin 506. As described in greater detail below, hook pin 502 may be used to attach any one of plurality of hooks 300 to any one of the plurality of bending shoes 200. Also as described in greater detail below, clevis pin 504 may be used to attach any one of plurality of bending shoes 200 to the clevis disposed at the bottom of the throw extending from main bending cylinder 103. Furthermore, assist pin 506 may be used to hold any one of plurality of hooks 300 to a conduit that is to be bent by hydraulic conduit bender 100.

Figure 6:
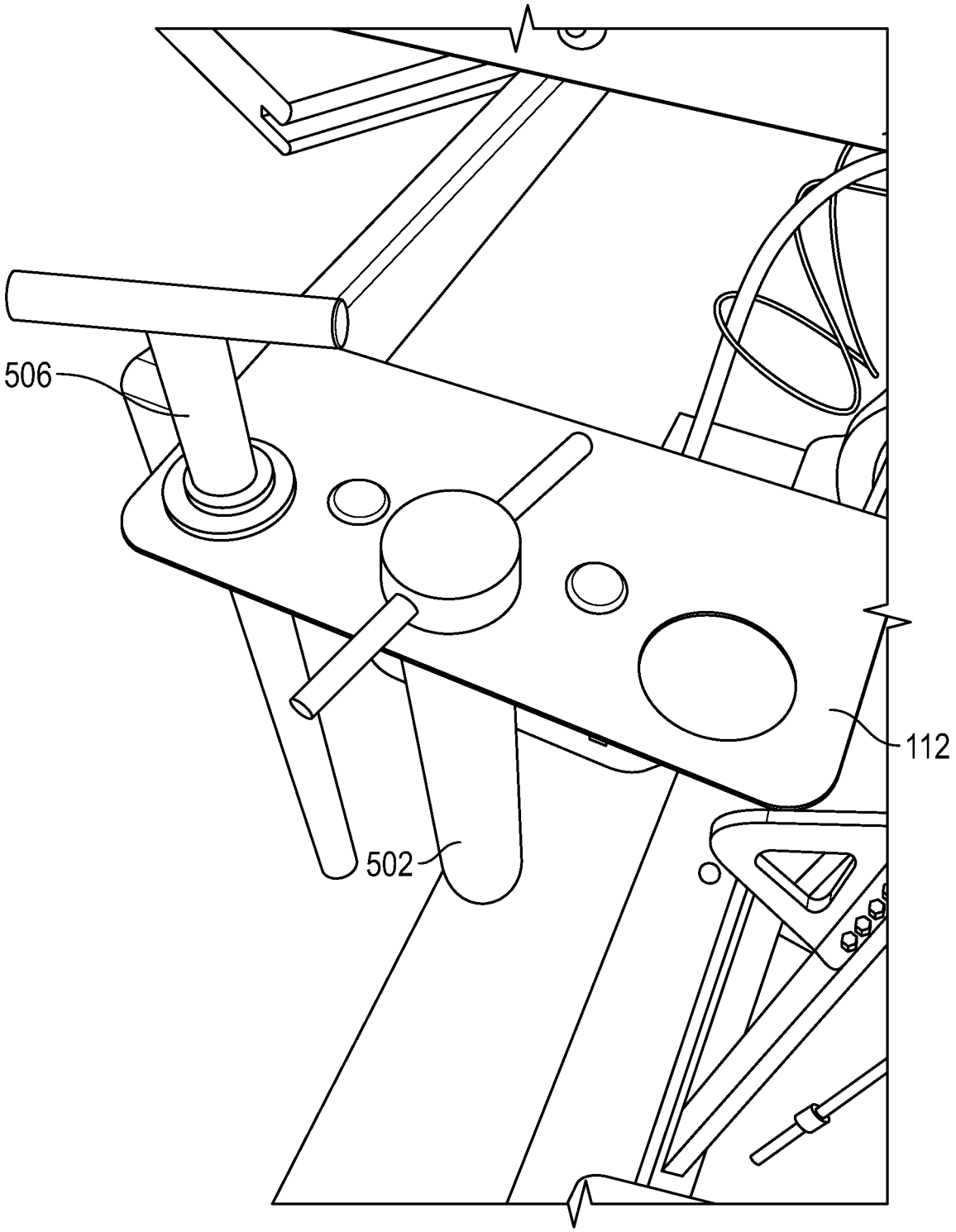
FIG. 6 shows a tool tray.

FIG. 6 illustrates tool tray 112 in greater detail. As shown in FIG. 6, tool tray 112 may be attached to hydraulic conduit bender 100 and may be used to store hook pin 502, clevis pin 504, and assist pin 506. Holes in tool tray 112 may accommodate hook pin 502, clevis pin 504, and assist pin 506. FIG. 6 illustrates hook pin 502 and assist pin 506 being stored on tool tray 112 and an open hole for accommodating clevis pin 504.

Figure 7:
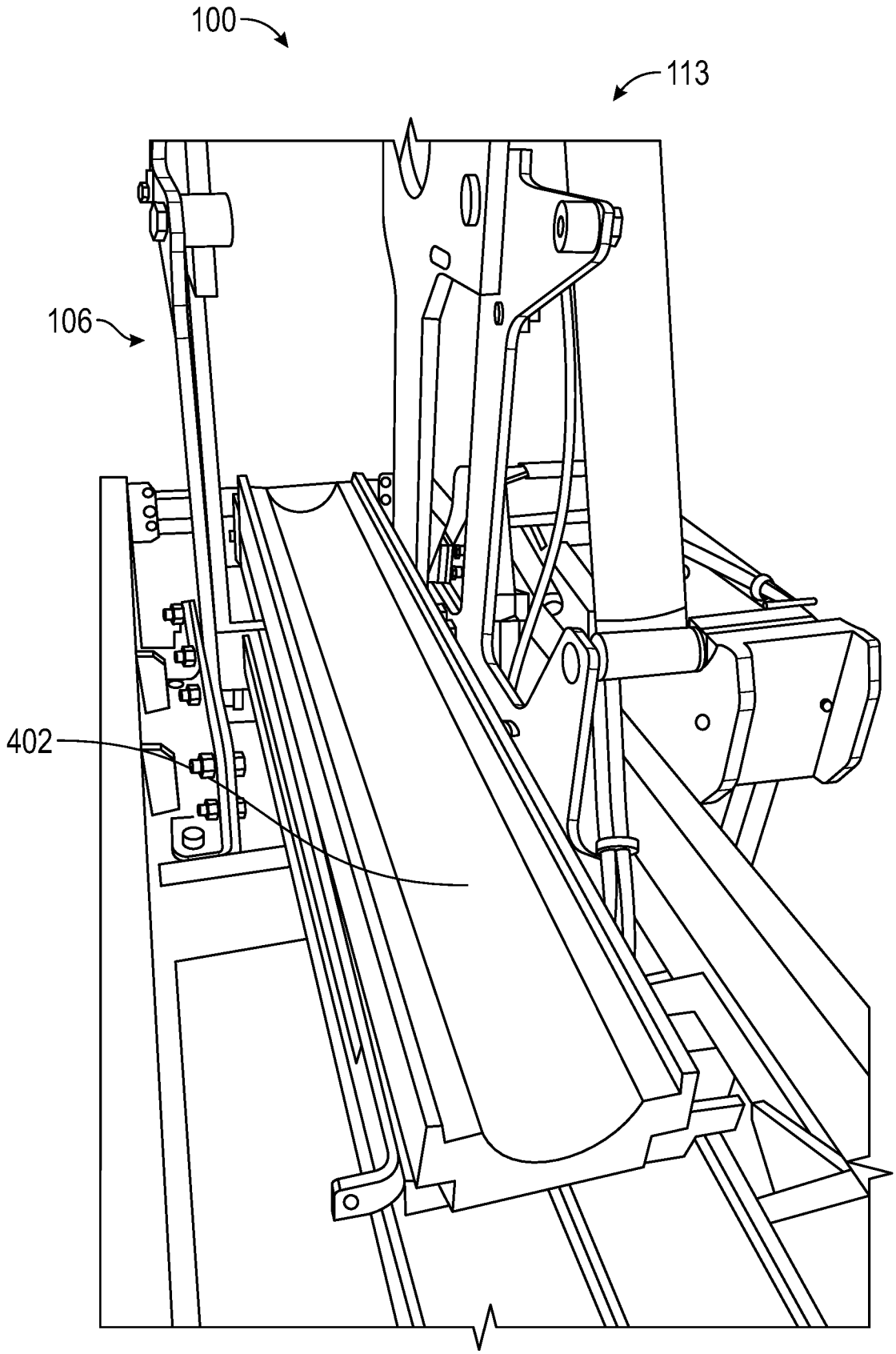
FIG. 7 illustrates a follow bar on the hydraulic conduit bender.

FIG. 7 illustrates hydraulic conduit bender 100. As shown in FIG. 7, mast 113 may be raised in the working position. One of plurality of follow bars 400 (e.g., follow bar 402) may be placed on hydraulic conduit bender 100 in yoke 106. For example, a 2.5 inch conduit (e.g., galvanized EMT) may need to be bent so an operator may select follow bar 402 from follow bar storage 102 and place follow bar 402 on hydraulic conduit bender 100 in yoke 106. During the bending operation of the conduit, the conduit may be placed on follow bar 402 and follow bar 402 may move along with the conduit in yoke 106 as the conduit is being bent. Vise 108 may be used hold the conduit steady during bending.

Figure 8:
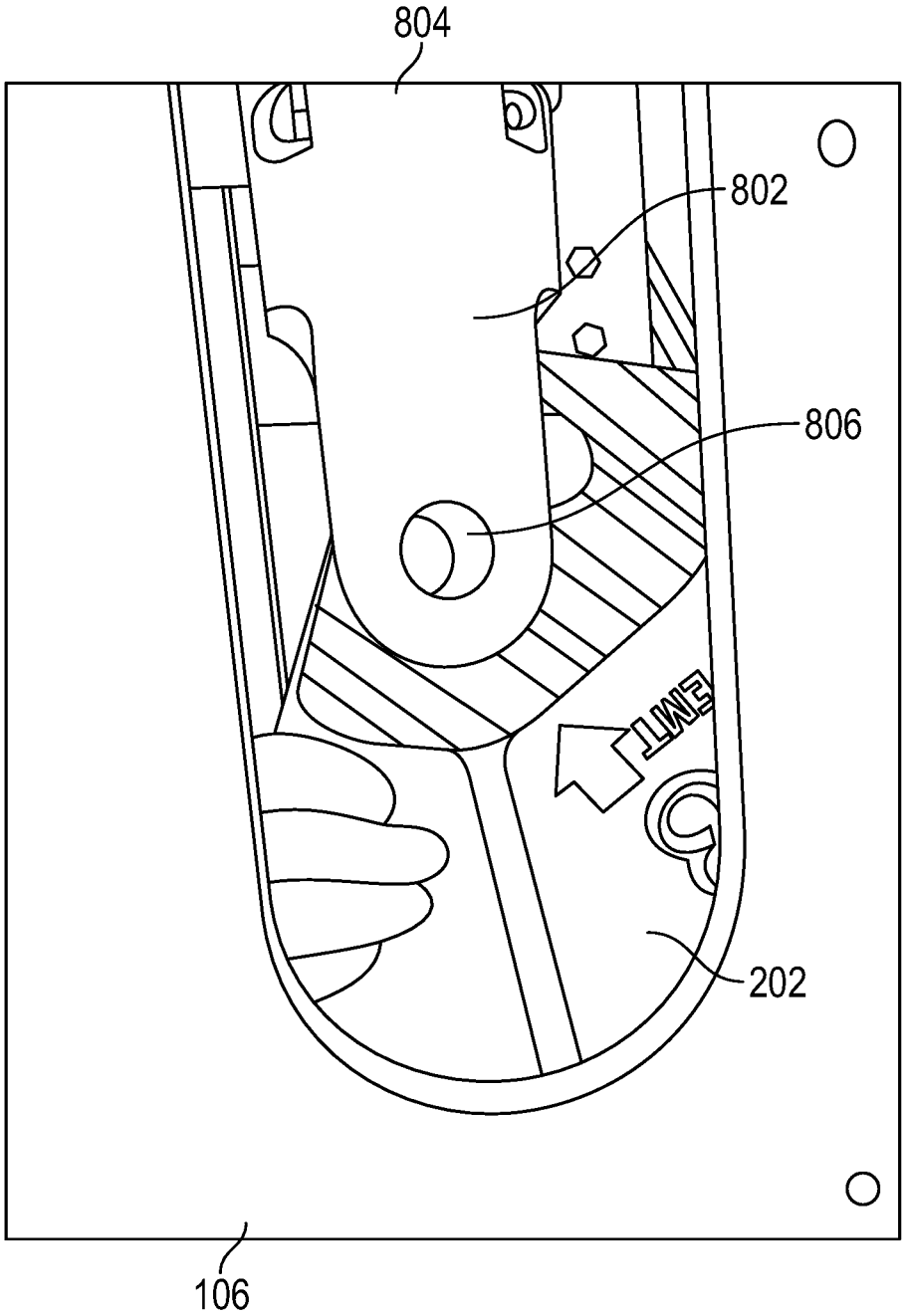
FIG. 8 illustrates the attachment of a bending shoe on the hydraulic conduit bender.

FIG. 8 illustrates the attachment of a bending shoe on hydraulic conduit bender 100. One of plurality of bending shoes 200 (e.g., first bending shoe 202) may be placed on hydraulic conduit bender 100 in yoke 106. For example, a 2.5 inch conduit (e.g., galvanized EMT) may need to be bent so an operator may select first bending shoe 202 from bending shoe storage 101 and place first bending shoe 202 on hydraulic conduit bender 100 in yoke 106.

As shown in FIG. 8, a clevis 802 may be disposed at a bottom of a throw 804 extending from a bottom of main bending cylinder 103. The operator may use main control panel 104 to accurately adjust throw 804 up and down from main bending cylinder 103 in order to line clevis holes 806 with first clevis pin hole 210 in first bending shoe 202. As stated in the aforementioned example, first clevis pin hole 210 may be used when the conduit comprises galvanized EMT. After this alignment, clevis pin 504 may be deployed in clevis holes 806 and first clevis pin hole 210 in order to attach first bending shoe 202 to clevis 802 of throw 804.

Consistent with embodiments of the disclosure, any of plurality of bending shoes 200 may be attached to clevis 802 of throw 804 without having to adjust the position of main bending cylinder 103 vertically within yoke 106. With conventional systems, a bending cylinder must be detached and reattached at a different vertical location when different sized bending shoes are used. With embodiments of the disclosure the position of main bending cylinder 103 does not need to adjusted, rather the clevis 802 of throw 804 may be adjusted vertically by an operator using main control panel 104 to accommodate different sized bending shoes. Main bending cylinder 103 may comprise a dual-action cylinder that may enable fast and precise, in and out, vertical adjustments of the clevis 802 of throw 804 by the operator.

Figure 9:
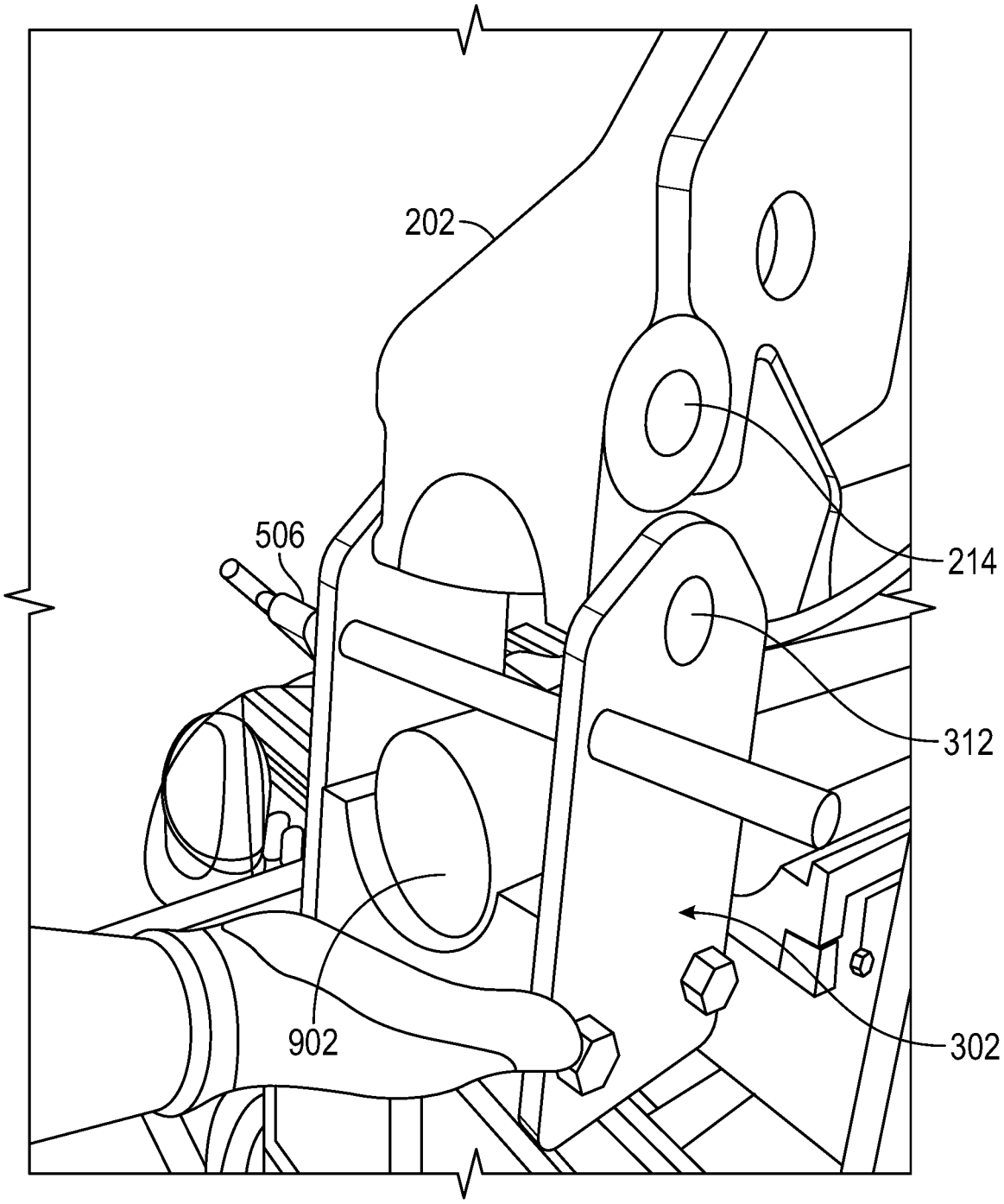
FIG. 9 illustrates the attachment of a hook onto a bending shoe on the hydraulic conduit bender.

FIG. 9 illustrates the attachment of a hook onto a bending shoe on hydraulic conduit bender 100. One of plurality of hooks 300 (e.g., first hook 302) may be placed on hydraulic conduit bender 100 in yoke 106. For example, a 2.5 inch conduit (e.g., galvanized EMT) may need to be bent so an operator may select first hook 302 from hook storage 110 and place first hook 302 on hydraulic conduit bender 100.

Figure 10:
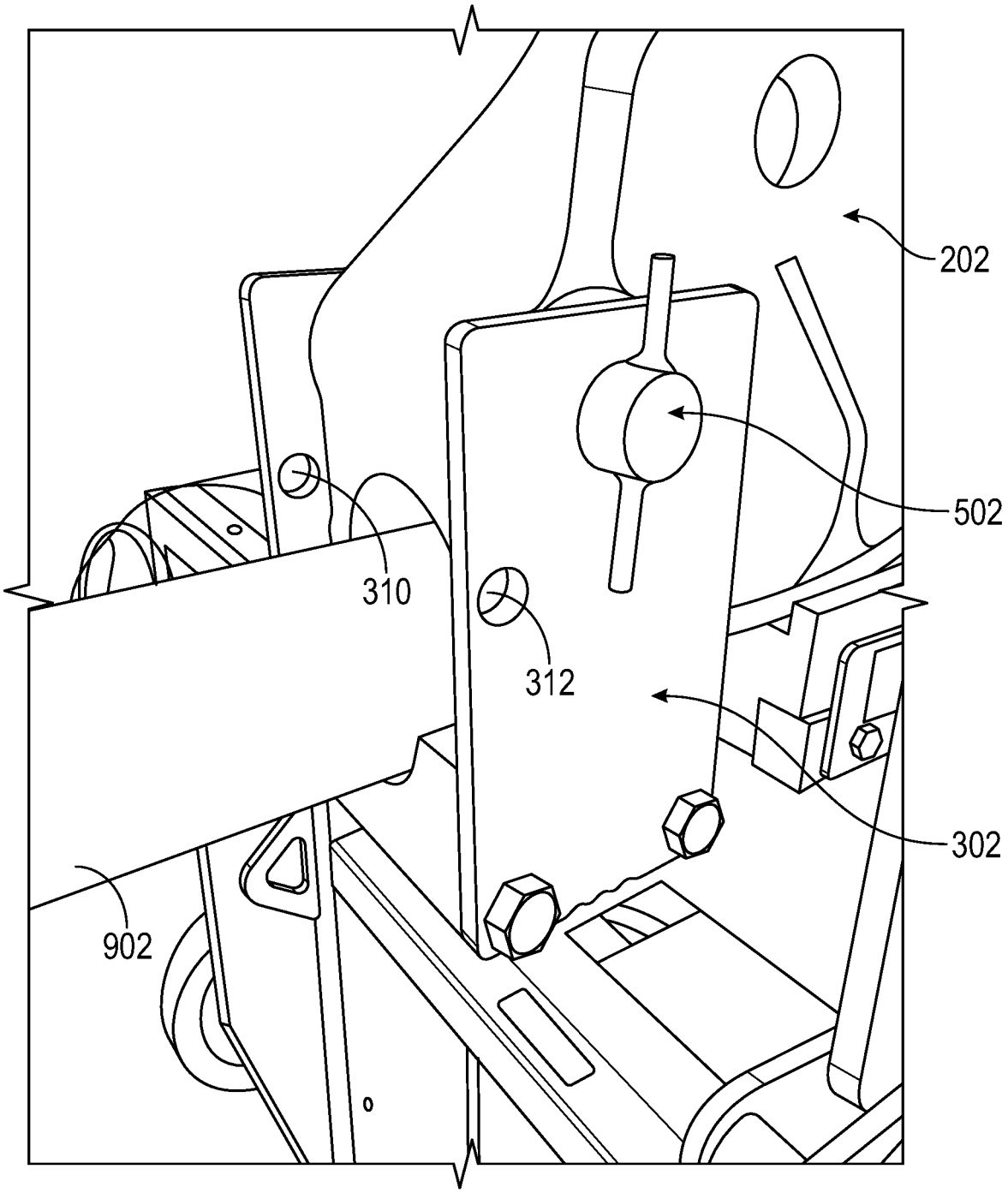
FIG. 10 illustrates the deployment of a hook pin.

As shown in FIG. 9, first hook 302 may be saddled under a conduit 902 (e.g., 2.5 inch galvanized EMT conduit) that is disposed in hydraulic conduit bender 100. After first hook 302 is saddled under conduit 902, assist pin 506 may be slipped through first assist pin hole 314 and second assist pin hole 316. In this way conduit 902 may fit snuggly between a saddled of first hook 302 and assist pin 506, and first hook 302 may be held in place by assist pin 506 while first hook 302 is being attached to first bending shoe 202. The operator may now adjust first hook 302 (attached to conduit 902) and first bending shoe 202 until first hook pin hole 310 and second hook pin hole 312 align with hook pin hole 214 at which time hook pin 502 may be deployed in the aligned first hook pin hole 310, second hook pin hole 312, and hook pin hole 214 as shown in FIG. 10. Accordingly first hook 302 may be attached to first bending shoe 202. After this attachment, assist pin 506 may be removed and stored in tool tray 112.

Figure 11:
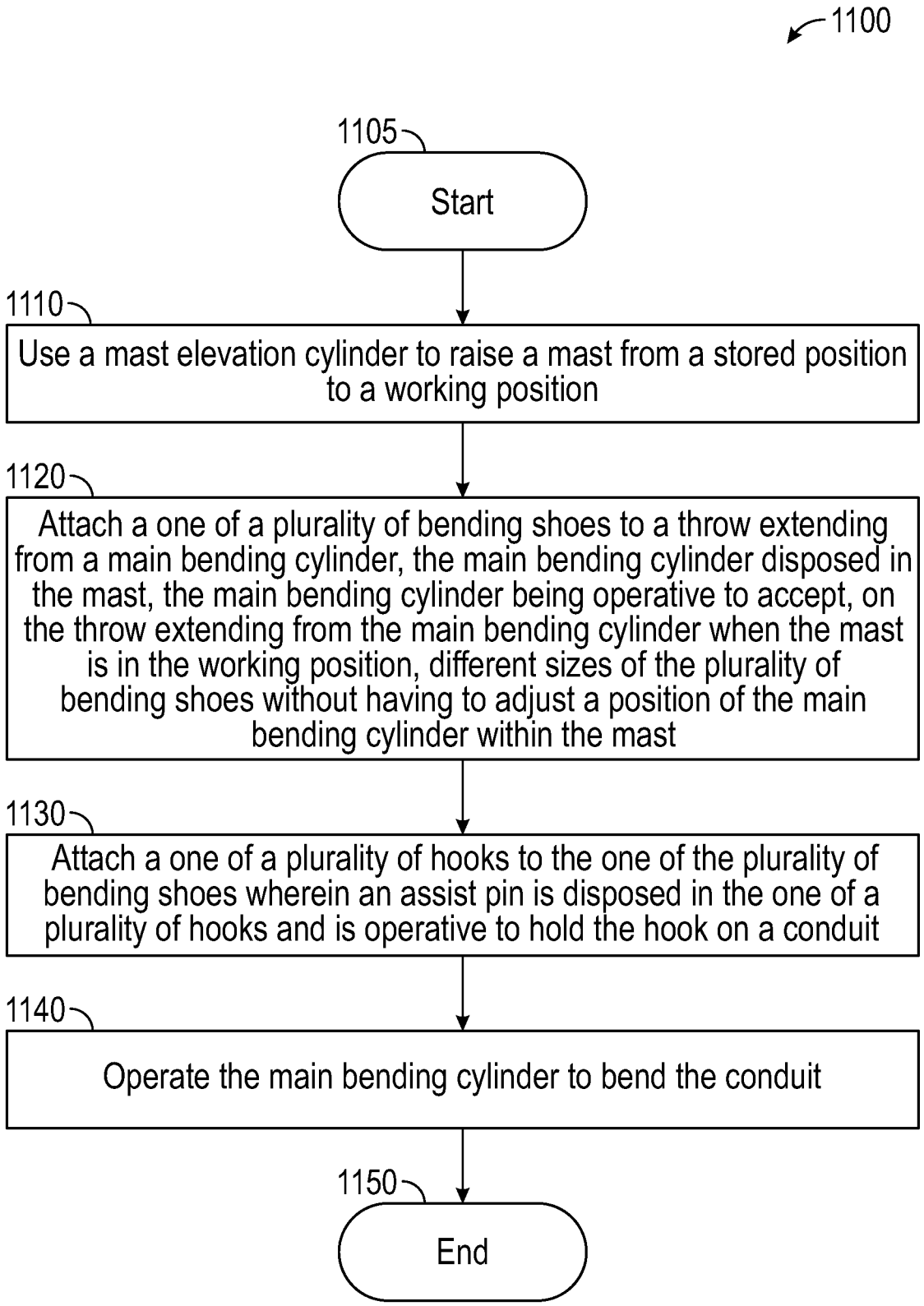
FIG. 11 shows a method for bending a conduit.

FIG. 11 is a flow chart setting forth the general stages involved in a method 1100 consistent with an embodiment of the disclosure for bending a conduit. Method 1100 may be implemented the operator using hydraulic conduit bender 100 as described in more detail above. Ways to implement the stages of method 1100 will be described in greater detail below.

Method 1100 may begin at starting block 1105 and proceed to stage 1110 where the operator may use mast elevation cylinder 105 to raise mast 113 from the stored position to the working position. For example, the operator of hydraulic conduit bender 100, using main control panel 104, may cause mast elevation cylinder 105 to rotate mast 113 about pivot point 114 and go from the stored position (i.e., substantially horizontal) to the working position (i.e., substantially vertical). FIG. 1A and FIG. 1B show mast 113 of hydraulic conduit bender 100 in the working position. Elevation mast lock 109 may lock mast 113 in the stored position or in the working position. Elevation mast lock 109 may be actuated by the operator to unlock mast 113 from the stored position or from the working position.

From stage 1110, where the operator uses mast elevation cylinder 105 to raise mast 113 from the stored position to the working position, method 1100 may advance to stage 1120 the operator may attach a one of plurality of bending shoes 200 to throw 804 extending from main bending cylinder 103 disposed in mast 113. Main bending cylinder 103 may be operative to accept, on throw 804 extending from main bending cylinder 103 when mast 113 is in the working position, different sizes of plurality of bending shoes 200 without having to adjust the position of main bending cylinder 103 within mast 113. For example, as shown in FIG. 8, clevis 802 may be disposed at the bottom of throw 804 extending from the bottom of main bending cylinder 103. The operator may use main control panel 104 to accurately adjust throw 804 up and down from main bending cylinder 103 in order to line clevis holes 806 with first clevis pin hole 210 of first bending shoe 202. As stated in the aforementioned example, first clevis pin hole 210 may be used when the conduit comprises galvanized EMT. After this alignment, clevis pin 504 may be deployed in clevis holes 806 and first clevis pin hole 210 in order to attach first bending shoe 202 to clevis 802 of throw 804.

Consistent with embodiments of the disclosure, any of plurality of bending shoes 200 may be attached to clevis 802 of throw 804 without having to adjust the position of main bending cylinder 103 vertically within yoke 106. With conventional systems, a bending cylinder must be detached and reattached at a different vertical location when different sized bending shoes are used. With embodiments of the disclosure the position of main bending cylinder 103 does not need to adjusted, rather the clevis 802 of throw 804 may be adjusted vertically to accommodate different sized bending shoes.

Once the operator attaches one of a plurality of bending shoes 200 to throw 804 extending from main bending cylinder 103 disposed in mast 113 in stage 1120, method 1100 may continue to stage 1130 where the operator may attach a one of plurality of hooks 300 to the one of plurality of bending shoes 200. Assist pin 506 may be disposed in the one of the plurality of hooks 300 and may be operative to hold the hook on the conduit. For example, FIG. 9 illustrates the attachment of the hook onto the bending shoe on hydraulic conduit bender 100. One of plurality of hooks 300 (e.g., first hook 302) may be placed on hydraulic conduit bender 100 in yoke 106. For example, a 2.5 inch conduit (e.g., galvanized EMT) may need to be bent so an operator may select first hook 302 from hook storage 110 and place first hook 302 on hydraulic conduit bender 100.

As shown in FIG. 9, first hook 302 may be saddled under a conduit 902 (e.g., 2.5 inch galvanized EMT conduit) that is disposed in hydraulic conduit bender 100. After first hook 302 is saddled under conduit 902, assist pin 506 may be slipped through first assist pin hole 314 and second assist pin hole 316. In this way conduit 902 may fit snuggly between a saddled of first hook 302 and assist pin 506, and first hook 302 may be held in place by assist pin 506 while first hook 302 is being attached to first bending shoe 202. The operator may now adjust first hook 302 (attached to conduit 902) and first bending shoe 202 until first hook pin hole 310 and second hook pin hole 312 align with hook pin hole 214 at which time hook pin 502 may be deployed in the aligned first hook pin hole 310, second hook pin hole 312, and hook pin hole 214 as shown in FIG. 10. Accordingly first hook 302 may be attached to first bending shoe 202. After this attachment, assist pin 506 may be removed and stored in tool tray 112.

After the operator attaches one of a plurality of hooks 300 to one of the plurality of bending shoes 200 in stage 1130, method 1100 may proceed to stage 1140 where the operator may operate main bending cylinder 103 to bend the conduit. For example, the operator may use main control panel 104 to cause throw 804 to move out of main bending cylinder 103 and cause first bending shoe 202 to rotate. With conduit 902 attached to first bending shoe 202 via first hook 302, conduit 902 may bend with the rotation of first bending shoe 202. Once the operator operates main bending cylinder 103 to bend the conduit in stage 1140, method 1100 may then end at stage 1150.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. An apparatus comprising:

a mast rotatable about a pivot point between a stored position and a working position;

a main bending cylinder disposed in the mast;

a throw powered to move the throw in both a direction out of the main bending cylinder and a direction into the main bending cylinder;

a plurality of follow bars; and a plurality of bending shoes corresponding to each of the plurality of follow bars;

wherein the main bending cylinder is operative to accept, on the throw extending from the main bending cylinder when the mast is in the working position, each of the plurality of bending shoes without having to adjust a position of the main bending cylinder within the mast.

2. The apparatus of claim 1, further comprising a mast elevation cylinder operative to rotate the mast from a stored position to the working position.

3. The apparatus of claim 2, wherein the mast elevation cylinder is further operative to return the mast from the working position to the stored position.

4. The apparatus of claim 1, wherein one of the plurality of bending shoes is attached to the throw extending from the main bending cylinder.

5. The apparatus of claim 4, wherein one of a plurality of hooks is attached to the one of the plurality of bending shoes wherein an assist pin is disposed in the one of a plurality of hooks and is operative to hold the hook on a conduit.

6. The apparatus of claim 1, further comprising a tray operative to store at least one of a plurality of elements associated with operation of the apparatus.

7. The apparatus of claim 6, wherein the plurality of elements associated with operation of the apparatus comprise a hook pin, a clevis pin, and an assist pin.

8. The apparatus of claim 1, further comprising a plurality of hooks, wherein the plurality of follow bars respectively correspond to the plurality of hooks that respectively correspond to the plurality of bending shoes, and wherein indicia indicate which ones of the plurality of follow bars respectively correspond to which ones of the plurality of hooks that respectively correspond to which ones of the plurality of bending shoes.

9. The apparatus of claim 8, wherein the indicia comprises a color coding system.

10. The apparatus of claim 1, wherein the main bending cylinder is a dual-action cylinder.

11. The apparatus of claim 1, wherein the throw comprises a clevis.

12. The apparatus of claim 11, wherein one of the plurality of bending shoes being attached to the clevis by a clevis pin.

13. A method comprising:

using a mast elevation cylinder to rotate a mast of an apparatus about a pivot point from a stored position to a working position;

attaching one of a plurality of bending shoes to a throw extending from a main bending cylinder, without having to adjust a position of the main bending cylinder within the mast;

placing one of a plurality of follow bars on the apparatus;

placing a conduit on the follow bar;

attaching a one of a plurality of hooks to the one of the plurality of bending shoes wherein an assist pin is disposed in the one of a plurality of hooks and is operative to hold the one of a plurality of hooks on the conduit; and operating the main bending cylinder to bend the conduit.

14. The method of claim 13, further comprising storing, in a tray, at least one of a plurality of elements associated with operation of the apparatus wherein the plurality of elements associated with operation of the apparatus comprise a hook pin, a clevis pin, and an assist pin.

15. The method of claim 13, further comprising storing a plurality of follow bars and the plurality of hooks, wherein the plurality of follow bars respectively correspond to the plurality of hooks that respectively correspond to the plurality of bending shoes wherein indicia indicate which ones of the plurality of follow bars respectively correspond to which ones of the plurality of hooks that respectively correspond to which ones of the plurality of bending shoes.

16. The method of claim 15, wherein the indicia comprises a color coding system.

17. The method of claim 13, wherein attaching one of the plurality of bending shoes to the throw comprises adjusting a position of the throw vertically.

* * * * *